US009957460B2

(12) United States Patent
Qu et al.

(10) Patent No.: US 9,957,460 B2
(45) Date of Patent: May 1, 2018

(54) IONIC LIQUIDS CONTAINING SYMMETRIC QUATERNARY PHOSPHONIUM CATIONS AND PHOSPHORUS-CONTAINING ANIONS, AND THEIR USE AS LUBRICANT ADDITIVES

(71) Applicant: UT-Battelle, LLC, Oak Ridge, TN (US)

(72) Inventors: Jun Qu, Oak Ridge, TN (US); Huimin Luo, Knoxville, TN (US)

(73) Assignee: UT-BATTELLE, LLC, Oak Ridge, TN (US)

( * ) Notice: Subject to any disclaimer, the term of this patent is extended or adjusted under 35 U.S.C. 154(b) by 97 days.

(21) Appl. No.: 14/184,754

(22) Filed: Feb. 20, 2014

(65) Prior Publication Data

US 2015/0232777 A1 Aug. 20, 2015

(51) Int. Cl.
*C10M 137/12* (2006.01)
*C10M 137/04* (2006.01)
(Continued)

(52) U.S. Cl.
CPC ..... *C10M 137/12* (2013.01); *C10M 137/04* (2013.01); *C10M 137/10* (2013.01);
(Continued)

(58) Field of Classification Search
CPC ..... C10M 137/12; C10M 137/04; C10M 137/10; C10M 171/00; C10M 2203/1025;
(Continued)

(56) References Cited

U.S. PATENT DOCUMENTS 3,654,342 A 4/1972 Gillham et al.
3,707,501 A * 12/1972 Gentit et al. ..... C10M 137/12 252/389.22
(Continued)

FOREIGN PATENT DOCUMENTS

JP 2013-60551 4/2013
WO WO 2012/128714 A1 9/2012

OTHER PUBLICATIONS

Qu J. et al., "Comparison of an Oil-Miscible Ionic Liquid and ZDDP as a Lubricant Anti-Wear Additive", Tribology International 71:88-97 (2014).
(Continued)

*Primary Examiner* — James Goloboy
(74) *Attorney, Agent, or Firm* — Scully Scott Murphy & Presser

(57) ABSTRACT

An ionic liquid composition having the following generic structural formula:

(1)

wherein $R^1$, $R^2$, $R^3$, and $R^4$ are equivalent and selected from hydrocarbon groups containing at least three carbon atoms, and $X^-$ is a phosphorus-containing anion, particularly an organophosphate, organophosphonate, or organophosphinate anion, or a thio-substituted analog thereof containing hydrocarbon groups with at least three carbon atoms. Also described are lubricant compositions comprising the above ionic liquid and a base oil, wherein the ionic liquid is dissolved in the base oil. Further described are methods for applying the ionic liquid or lubricant composition onto a
(Continued)

[P8888][DEHP] [P66614][DEHP] [P44414][DEHP]

mechanical device for which lubrication is beneficial, with resulting improvement in friction reduction, wear rate, and/or corrosion inhibition.

9 Claims, 10 Drawing Sheets

(51) Int. Cl.
*C10M 137/10* (2006.01)
*C10M 171/00* (2006.01)

(52) U.S. Cl.
CPC .. *C10M 171/00* (2013.01); *C10M 2203/1025* (2013.01); *C10M 2223/04* (2013.01); *C10M 2223/045* (2013.01); *C10M 2223/06* (2013.01); *C10N 2210/02* (2013.01); *C10N 2230/06* (2013.01); *C10N 2230/08* (2013.01); *C10N 2230/10* (2013.01); *C10N 2230/70* (2013.01)

(58) Field of Classification Search
CPC ..... C10N 2210/02; C10N 2230/06; C10N 2230/08; C10N 2230/10; C10N 2230/70
USPC ..... 508/369
See application file for complete search history.

(56) References Cited

U.S. PATENT DOCUMENTS 4,038,258 A * 7/1977 Singh ..... C08K 5/50 260/DIG. 16
5,767,045 A * 6/1998 Ryan ..... C10M 141/10 252/78.5
8,258,088 B2 9/2012 Bodesheim et al.
8,268,760 B2 9/2012 Habeeb et al.
8,455,407 B2 6/2013 Schmidt-Amelunxen et al.
2009/0036334 A1 2/2009 Schwab et al.
2009/0062471 A1* 3/2009 Prasse ..... C08G 65/33306 525/101
2009/0069204 A1* 3/2009 Kamimura ..... C10M 169/04 508/100
2009/0270286 A1 10/2009 Kawata et al.
2010/0084597 A1 4/2010 Schwab et al.
2010/0093577 A1 4/2010 Ritchie et al.
2010/0187481 A1 7/2010 Bodesheim et al.
2010/0252146 A1 10/2010 Qu et al.
2010/0267980 A1* 10/2010 Tsunashima ..... C08G 59/42 558/87
2012/0178658 A1 7/2012 Tredget
2013/0053287 A1 2/2013 Honda et al.
2013/0078170 A1 3/2013 Dai et al.
2015/0090369 A1 4/2015 Qu et al.

OTHER PUBLICATIONS

Qu J. et al., "Antiwear Performance and Mechanism of an Oil-Miscible Ionic Liquid as a Lubricant Additive", ACS App. Mater. Interfaces 4:997-1002 (2012).
Qu J. et al., "Oil-Miscible Phosphonium-and Ammonium-Phosphate Ionic Liquids as Potential Ashless Anti-Wear Lubricant Additives", presented at the STLE 68th Annual Meeting, May 5-9, 2013, Detroit, Michigan.
Yu B. et al., "Oil-Miscible and Non-Corrosive Phosphonium-Based Ionic Liquids as Candidate Lubricant Additives", Wear 289:58-64 (2012).

* cited by examiner (2A)

(2B)

(2C)

(4A)

(4B)

IONIC LIQUIDS CONTAINING SYMMETRIC QUATERNARY PHOSPHONIUM CATIONS AND PHOSPHORUS-CONTAINING ANIONS, AND THEIR USE AS LUBRICANT ADDITIVES

This invention was made with government support under Prime Contract No. DE-AC05-00OR22725 awarded by the U.S. Department of Energy. The government has certain rights in the invention.

FIELD OF THE INVENTION

The present invention relates generally to the fields of ionic liquids, and more particularly, to their application as additives in lubricating oils, such as engine and motor oils.

BACKGROUND OF THE INVENTION

Ionic liquids have been explored as lubricant additives for at least the last decade. However, several drawbacks have been encountered with the ionic liquids used in the art for this purpose. In particular, the ionic liquids used in the art generally possess lower than desirable (or insufficient) solubility in base oils into which they are included, which results in either the use of very low additive concentrations or separation of the additive from the base oil during use. The low solubility of many ionic liquids in base oils is a significant obstacle to their use since the low concentrations used and/or incomplete miscibility results in substandard or inconsistent wear and friction control. Thus, there is a need for improving the solubility of ionic liquids in various lubricating oils. Moreover, there is a need for new ionic liquid compositions having improved anti-wear and friction reduction properties.

SUMMARY OF THE INVENTION

In one aspect, the instant invention is directed to an ionic liquid useful as a lubricant additive or lubricant itself, wherein the ionic liquid contains a quaternary phosphonium cation that is symmetric (i.e., all hydrocarbon groups on the phosphorus atom are the same) and a phosphorus-containing anion, particularly a phosphate, phosphonate, or phosphinate anion, or a thio-substituted analog of such an anion.

In specific embodiments, the ionic liquid has the following generic formula:

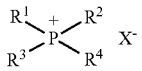

(1)

In Formula (1), $R^1$, $R^2$, $R^3$, and $R^4$ are equivalent and selected from hydrocarbon groups containing at least three carbon atoms, and $X^-$ is a phosphorus-containing anion having the following generic formula:

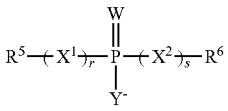

(2)

wherein $R^5$ and $R^6$ are independently selected from hydrocarbon groups having at least three carbon atoms, and $R^5$ and $R^6$ may optionally interconnect to form a ring. The variables $X^1$, $X^2$, W, and Y are independently selected from O and S atoms, and subscripts r and s are independently selected from 0 and 1. Any of the hydrocarbon groups are optionally substituted with one or more fluorine atoms.

In another aspect, the invention is directed to a lubricant composition that contains the ionic liquid described above and a base oil, wherein the ionic liquid is dissolved in the base oil. The ionic liquid possesses complete solubility in the base oil when included in the base oil in amounts of, for example, at least 0.1, 0.5, 1, 2, 5, 10, 12, 15, 20, or 50 wt % by weight of the lubricant composition. To ensure complete solubility in a base oil, the hydrocarbon groups on the cation and the anion typically contain, independently, at least 3, 4, 5, 6, 7, or 8 carbon atoms.

In another aspect, the invention is directed to a method for reducing wear and/or reducing friction in mechanical components designed for movement by applying the ionic liquid, either in neat form or as part of a lubricating composition, as described above, onto the mechanical components. The mechanical component can be any mechanical part known in the art for which lubricity could be beneficial. The mechanical component is typically constructed of metal, and can be, for example, a bearing, piston, turbine, fan, gear, shaft, axle, linkage, pump, motor, rotary blade, compressor, or engine, or component used in a manufacturing process.

DETAILED DESCRIPTION OF THE INVENTION

Figure 1:
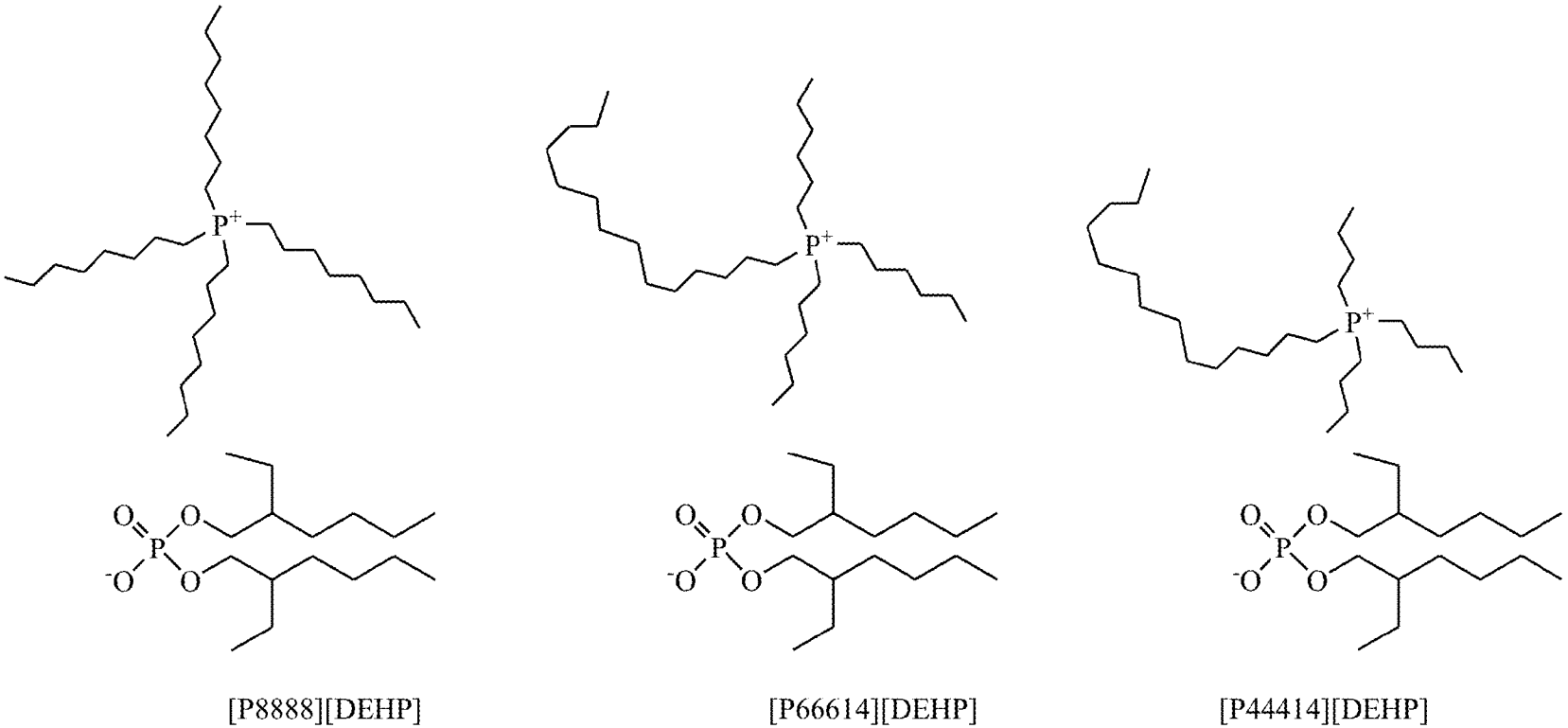
FIG. 1. Chemical structures of three ionic liquids: tetraoctylphosphonium bis(2-ethylhexyl)phosphate ([P8888][DEHP]), trihexyltetradecylphosphonium bis(2-ethylhexyl) phosphate ([P66614][DEHP]) and tributyltetradecylphosphonium bis(2-ethylhexyl)phosphate ([P44414][DEHP]), wherein the symmetric [P8888][DEHP] is in accordance with the instant disclosure, and asymmetric [P66614][DEHP] and [P44414][DEHP] are included for comparison.

As used herein, the term "about" generally indicates within ±0.5%, 1%, 2%, 5%, or up to ±10% of the indicated value. For example, the term "about 100° C." generally indicates, in its broadest sense, 100° C.±10%, which indicates 90-110° C. The term "about" may alternatively indicate a variation or average in a physical characteristic of a group.

The term "hydrocarbon group" or "hydrocarbon linker" (also identified as "R"), as used herein, designates, in a first embodiment, groups or linkers composed solely of carbon and hydrogen. In different embodiments, one or more of the hydrocarbon groups or linkers can contain precisely, or a minimum of (i.e., at least), or a maximum of (i.e., up to), for example, one, two, three, four, five, six, seven, eight, nine, ten, eleven, twelve, thirteen, fourteen, fifteen, sixteen, seventeen, eighteen, nineteen, or twenty carbon atoms, or a number of carbon atoms within a particular range bounded by any two of the foregoing carbon numbers. Hydrocarbon groups or linkers in different compounds described herein, or in different parts or positions of a compound, may possess the same or different number (or preferred range thereof) of carbon atoms in order to independently adjust or optimize the activity or other characteristics of the compound, such as its level of hydrophobicity or solubility level in a hydrophobic medium, or its wear-enhancing or friction-reducing ability.

The hydrocarbon groups or linkers (R) can be, for example, saturated and straight-chained, i.e., straight-chained alkyl groups or alkylene linkers. Some examples of straight-chained alkyl groups (or alkylene linkers) include methyl (or methylene linker, i.e., —$CH_2$—, or methine linker), ethyl (or ethylene or dimethylene linker, i.e., —$CH_2CH_2$— linker), n-propyl, n-butyl, n-pentyl, n-hexyl, n-heptyl, n-octyl, n-nonyl, n-decyl, n-undecyl, n-dodecyl, n-tridecyl, n-tetradecyl, n-pentadecyl, n-hexadecyl, n-heptadecyl, n-octadecyl, n-nonadecyl, and n-eicosyl groups (or their respective linker analogs).

The hydrocarbon groups or linkers (R) can alternatively be saturated and branched, i.e., branched alkyl groups or alkylene linkers. Some examples of branched alkyl groups include isopropyl (2-propyl), isobutyl (2-methylprop-1-yl), sec-butyl (2-butyl), t-butyl, 2-pentyl, 3-pentyl, 2-methylbut-1-yl, isopentyl (3-methylbut-1-yl), 1,2-dimethylprop-1-yl, 1,1-dimethylprop-1-yl, neopentyl (2,2-dimethylprop-1-yl), 2-hexyl, 3-hexyl, 2-methylpent-1-yl, 3-methylpent-1-yl, isohexyl (4-methylpent-1-yl), 1,1-dimethylbut-1-yl, 1,2-dimethylbut-1-yl, 2,2-dimethylbut-1-yl, 2,3-dimethylbut-1-yl, 3,3-dimethylbut-1-yl, 1,1,2-trimethylprop-1-yl, 1,2,2-trimethylprop-1-yl, 2-ethylhexyl, isoheptyl, isooctyl, isononyl, and isodecyl, wherein the "1-yl" suffix represents the point of attachment of the group. Some examples of branched alkylene linkers are those derived by removal of a hydrogen atom from one of the foregoing exemplary branched alkyl groups, e.g., isopropylene (—$CH(CH_3)CH_2$—).

The hydrocarbon groups or linkers (R) can alternatively be saturated and cyclic, i.e., cycloalkyl groups or cycloalkylene linkers. Some examples of cycloalkyl groups include cyclopropyl, cyclobutyl, cyclopentyl, cyclohexyl, cycloheptyl, and cyclooctyl groups. The cycloalkyl group can also be a polycyclic (e.g., bicyclic) group by either possessing a bond between two ring groups (e.g., dicyclohexyl) or a shared (i.e., fused) side, e.g., decalin and norbornane. Some examples of cycloalkylene linkers are those derived by removal of a hydrogen atom from one of the foregoing exemplary cycloalkyl groups.

The hydrocarbon groups or linkers (R) can alternatively be unsaturated and straight-chained, i.e., straight-chained olefinic or alkenyl groups or linkers. The unsaturation occurs by the presence of one or more carbon-carbon double bonds and/or one or more carbon-carbon triple bonds. Some examples of straight-chained olefinic groups include vinyl, 2-propen-1-yl (allyl), 3-buten-1-yl ($CH_2$═CH—$CH_2$—$CH_2$—), 2-buten-1-yl ($CH_2$—CH═CH—$CH_2$—), butadienyl (e.g., 1,3-butadien-1-yl), 4-penten-1-yl, 3-penten-1-yl, 2-penten-1-yl, 2,4-pentadien-1-yl, 5-hexen-1-yl, 4-hexen-1-yl, 3-hexen-1-yl, 3,5-hexadien-1-yl, 1,3,5-hexatrien-1-yl, 4-hepten-1-yl, 5-hepten-1-yl, 6-hepten-1-yl, 4-octen-1-yl, 5-octen-1-yl, 6-octen-1-yl, 7-octen-1-yl, 2,6-octadien-1-yl, 8-decenyl, 9-decenyl, or 4,8-decadien-1-yl, ethynyl, propargyl (2-propynyl), and the numerous $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, and $C_{20}$ unsaturated and straight-chained hydrocarbon groups. Some examples of straight-chained olefinic linkers are those derived by removal of a hydrogen atom from one of the foregoing exemplary straight-chained olefinic groups, e.g., vinylene (—CH═CH—, or vinylidene).

The hydrocarbon groups or linkers (R) can alternatively be unsaturated and branched, i.e., branched olefinic or alkenyl groups or linkers. Some examples of branched olefinic groups include propen-2-yl ($CH_2$═C.—$CH_3$), 1-buten-2-yl ($CH_2$═C.—$CH_2$—$CH_3$), 1-buten-3-yl ($CH_2$═CH—CH.—$CH_3$), 1-propen-2-methyl-3-yl ($CH_2$—$C(CH_3)$—$CH_2$.), 1-penten-4-yl, 1-penten-3-yl, 1-penten-2-yl, 2-penten-2-yl, 2-penten-3-yl, 2-penten-4-yl, 1,4-pentadien-3-yl, 2,4-pentadien-3-yl, 3-methyl-2-buten-1-yl, 2,3-dimethyl-2-buten-1-yl, 4-methyl-2-penten-1-yl, 2-hexen-5-yl, and the numerous $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, and $C_{20}$ unsaturated and branched hydrocarbon groups. Some examples of branched olefinic linkers are those derived by removal of a hydrogen atom from one of the foregoing exemplary branched olefinic groups.

The hydrocarbon groups or linkers (R) can alternatively be unsaturated and cyclic (i.e., cycloalkenyl groups or cycloalkenylene linkers). The unsaturated and cyclic group can be aromatic or aliphatic. Some examples of unsaturated and cyclic hydrocarbon groups include cyclopropenyl, cyclobutenyl, cyclopentenyl, cyclopentadienyl, cyclohexenyl, cyclohexadienyl, phenyl, benzyl, cycloheptenyl, cycloheptadienyl, cyclooctenyl, cyclooctadienyl, and cyclooctatetraenyl groups. The unsaturated cyclic hydrocarbon group can also be a polycyclic group (such as a bicyclic or tricyclic polyaromatic group) by either possessing a bond between two of the ring groups (e.g., biphenyl) or a shared (i.e., fused) side, as in naphthalene, anthracene, phenanthrene, phenalene, or indene fused ring systems. Some examples of unsaturated cycloalkenylene linkers are those derived by removal of a hydrogen atom from one of the foregoing exemplary cycloalkenyl groups (e.g., phenylene and biphenylene).

One or more of the hydrocarbon groups or linkers (R) may (i.e., optionally) be substituted with (i.e., include) one or more heteroatoms, which are non-carbon non-hydrogen atoms. Some examples of heteroatoms include oxygen (O), nitrogen (N), sulfur (S), and halogen (halide) atoms, wherein some examples of halogen atoms include fluorine, chlorine, bromine, and iodine. In some embodiments, the heteroatom atom inserts between at least two carbon atoms (as in —C—O—C— ether, —C—N(R)—C— tertiary amine, or —C(═NR)C— imine) or between at least one carbon atom and at least one hydrogen atom (as in —C—OH, —C—SH, —C—$NH_2$, —C—NH—C—, or —C(═NH)C—), wherein the shown carbon atom in each case can be considered part of a hydrocarbon group R described above. In other embodiments, the heteroatom replaces one or more hydrogen atoms and/or one or more carbon atoms in the hydrocarbon group, as in halogen-substituted groups (e.g., as in —$CH_2F$, —$CHF_2$, and —$CF_3$) and carbonyl-substituted groups, such as ketone and aldehyde groups. In the case of nitrogen or sulfur substitution, the nitrogen or sulfur atom may be bonded to a sufficient number of groups to make it positively charged, as in an ammonium group (e.g., —$NR'_3^+$) or sulfonium group (e.g., —$SR'_2^+$), in which case the positively charged moiety is necessarily associated with a counteranion, wherein R' independently represents hydrogen atom or any of the hydrocarbon groups described above. Likewise, a heteroatom may bear a negative charge, as in a deprotonated alkoxide or thio group, in which case the negatively charged moiety is necessarily associated with a countercation.

When two or more same or different heteroatoms are bound to each other or located on the same carbon atom, the resulting group containing the heteroatoms is herein referred to as a "heteroatom-containing group". Thus, substitution with one or more heteroatoms also includes heteroatom-containing groups, unless otherwise specified. Some examples of heteroatom-containing groups and linkers include carboxy (—C(O)OR' or —OC(O)R'), carboxamide (—C(O)$NR'_2$, —C(O)NR'—, or —N(R')C(O)—), urea (—NR'—C(O)—$NR'_2$ or —NR'—C(O)—NR'—), carbamate (—NR'—C(O)—OR', —OC(O)—$NR'_2$, or —NR'—C(O)—O—), nitro ($NO_2$), nitrile (CN), sulfonyl (—$S(O)_2R'$ or —$S(O)_2$—), sulfonyl (i.e., sulfoxide, —S(O)R' or —S(O)—), disulfide (—C—S—S—C—), sulfonate (—$S(O)_2R'$), and amine oxide (as typically found in a nitrogen-containing ring), wherein R' independently represents hydrogen atom or any of the hydrocarbon groups (R) described above. For example, —C(O)OR' includes carboxylic acid (—C(O)OH) and carboxylic ester (—C(O)OR), wherein R can be any of the hydrocarbon groups described above. The heteroatom-containing group may also either insert between carbon atoms or between a carbon atom and hydrogen atom, if applicable, or replace one or more hydrogen and/or carbon atoms.

In some embodiments, the hydrocarbon group or linker (R) is substituted with one or more halogen atoms to result in a partially halogenated or perhalogenated hydrocarbon group. Some examples of partially halogenated hydrocarbon groups include —$CH_2X'$, —$CH_2CX'_3$, —$CH(CX'_3)_2$, or a monohalo-, dihalo-, trihalo-, or tetrahalo-substituted phenyl group, wherein X' represents any of F, Cl, Br, or I, and more commonly, F or Cl. Some examples of perhalogenated hydrocarbon groups include —$CX'_3$, —$CX'_2CX'_3$, —$CX'_2CX'_2CX'_3$, —$CX'(CX'_3)_2$, or a perhalophenyl group —$C_6X'_5$.

In particular embodiments, the hydrocarbon group (R) is, or includes, a cyclic or polycyclic (i.e., bicyclic, tricyclic, or higher cyclic) saturated or unsaturated (e.g., aliphatic or aromatic) hydrocarbon group that includes at least one ring heteroatom, such as one, two, three, four, or higher number of ring heteroatoms. Such heteroatom-substituted cyclic hydrocarbon groups are referred to herein as "heterocyclic groups". As used herein, a "ring heteroatom" is an atom other than carbon and hydrogen (typically, selected from nitrogen, oxygen, and sulfur) that is inserted into or replaces a ring carbon atom in a hydrocarbon ring structure. In some embodiments, the heterocyclic group is saturated, while in other embodiments, the heterocyclic group is unsaturated, i.e., aliphatic or aromatic heterocyclic groups, wherein the aromatic heterocyclic group is also referred to herein as a "heteroaromatic ring", or a "heteroaromatic fused-ring system" in the case of at least two fused rings, at least one of which contains at least one ring heteroatom.

Some examples of saturated heterocyclic groups containing at least one oxygen atom include oxetane, tetrahydrofuran, tetrahydropyran, 1,4-dioxane, 1,3-dioxane, and 1,3-dioxepane rings. Some examples of saturated heterocyclic groups containing at least one nitrogen atom include pyrrolidine, piperidine, piperazine, imidazolidine, azepane, and decahydroquinoline rings. Some examples of saturated heterocyclic groups containing at least one sulfur atom include tetrahydrothiophene, tetrahydrothiopyran, 1,4-dithiane, 1,3-dithiane, and 1,3-dithiolane rings. Some examples of saturated heterocyclic groups containing at least one oxygen atom and at least one nitrogen atom include morpholine and oxazolidine rings. An example of a saturated heterocyclic group containing at least one oxygen atom and at least one sulfur atom includes 1,4-thioxane. Some examples of saturated heterocyclic groups containing at least one nitrogen atom and at least one sulfur atom include thiazolidine and thiamorpholine rings.

Some examples of unsaturated heterocyclic groups containing at least one oxygen atom include furan, pyran, 1,4-dioxin, benzofuran, dibenzofuran, and dibenzodioxin rings. Some examples of unsaturated heterocyclic groups containing at least one nitrogen atom include pyrrole, imidazole, pyrazole, pyridine, pyrazine, pyrimidine, 1,3,5-triazine, azepine, diazepine, indole, purine, benzimidazole, indazole, 2,2'-bipyridine, quinoline, isoquinoline, phenanthroline, 1,4,5,6-tetrahydropyrimidine, 1,2,3,6-tetrahydropyridine, 1,2,3,4-tetrahydroquinoline, quinoxaline, quinazoline, pyridazine, cinnoline, 5,6,7,8-tetrahydroquinoxaline, 1,8-naphthyridine, and 4-azabenzimidazole rings. Some examples of unsaturated heterocyclic groups containing at least one sulfur atom include thiophene, thianaphthene, and benzothiophene rings. Some examples of unsaturated heterocyclic groups containing at least one oxygen atom and at least one nitrogen atom include oxazole, isoxazole, benzoxazole, benzisoxazole, oxazoline, 1,2,5-oxadiazole (furazan), and 1,3,4-oxadiazole rings. Some examples of unsaturated heterocyclic groups containing at least one nitrogen atom and at least one sulfur atom include thiazole, isothiazole, benzothiazole, benzoisothiazole, thiazoline, and 1,3,4-thiadiazole rings.

In some embodiments, any of the generic substituents described below may independently exclude any one or more of the classes, subclasses, or particular hydrocarbon groups described above, or may independently include only specific hydrocarbon groups selected from the hydrocarbon groups (R) described above. Similarly, any of the generic substituents described below may independently exclude any one or more heteroatoms or heteroatom-containing groups.

In one aspect, the invention is directed to an ionic liquid useful as a lubricant additive or lubricant itself, wherein the ionic liquid contains a quaternary phosphonium cation that is symmetric and a phosphorus-containing anion. The ionic liquid possesses complete solubility in a base oil when included in the base oil in amounts of at least 0.1, 0.5, 1, 2, 5, 10, 12, 15, or 20 wt % or within a concentration bounded by any two of these concentrations. The term "symmetric", as used herein, corresponds to all hydrocarbon groups on the phosphorus atom being the same. To ensure complete solubility in a base oil, the hydrocarbon groups on the cation and the anion independently include any of the hydrocarbon groups described above containing at least 3, 4, 5, 6, 7, 8, 9, 10, 11, 12, 13, 14, 15, 16, 17, or 18 carbon atoms or a number of carbon atoms within a range bounded by any two of the foregoing values, or between any of the foregoing values and 19 or 20 carbon atoms.

As understood in the art, the term "ionic liquid compound" or "ionic liquid" is an ionic compound that is, itself, a liquid, i.e., without being dissolved in or solvated with a solvent. The ionic liquid is typically a liquid at room temperature (e.g., 15, 18, 20, 22, 25, or 30° C.) or lower. However, in some embodiments, the ionic liquid may become a liquid at a temperature above 30° C. Thus, in some embodiments, the ionic liquid may have a melting point of up to or less than 100, 90, 80, 70, 60, 50, 40, or 30° C. In other embodiments, the ionic liquid is a liquid at or below 10, 5, 0, −10, −20, −30, or −40° C.

The density of the ionic liquid is typically in the range of 0.6-1.6 g/mL at an operating temperature of interest, and particularly at a temperature within 20-40° C. The viscosity of the ionic liquid is typically no more than 50,000 centipoise (50,000 cP) at an operating temperature of interest, and particularly at a temperature within 20-40° C. In different embodiments, the viscosity of the ionic liquid may be about, up to, less than, at least, or above, for example, 50, 100, 200, 300, 400, 500, 600, 700, 800, 900, 1000, 2000, 5000, 10,000, 15,000, 20,000, or 25,000 cP, or a viscosity within a range bounded by any two of these values.

In particular embodiments, the ionic liquid compositions are conveniently described by the following generic formula:

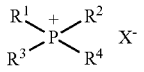

(1)

In Formula (1) above, $R^1$, $R^2$, $R^3$, and $R^4$ are all equivalent hydrocarbon groups containing at least three carbon atoms. The hydrocarbon group can be any of the R groups described above, i.e., saturated or unsaturated, straight-chained or branched, and cyclic or non-cyclic, as described above. In different embodiments, the hydrocarbon groups contain at least 3, 4, 5, or 6 carbon atoms and up to 7, 8, 9, 10, 11, 12, 14, 16, 18, or 20 carbon atoms, or at least 3, 4, 5, 6, 7, or 8 carbon atoms and up to 10, 12, 14, 16, 18, or 20 carbon atoms. The positive (+) charge shown in Formula (1) resides on the phosphorus (P) atom shown in Formula 1. However, one or more additional positive charges may exist elsewhere in the phosphonium moiety, which would add to the overall positive charge of the phosphonium moiety. The phosphonium moiety can be, for example, any of the phosphonium moieties disclosed in U.S. Pat. No. 3,654,342 and which are symmetric and contain hydrocarbon groups of at least three carbon atoms.

In a first set of embodiments, $R^1$, $R^2$, $R^3$, and $R^4$ are all equivalent saturated straight-chained alkyl groups. The straight-chained alkyl group can be any of those described above under R, particularly those having at least 3, 4, 5, 6, 7, 8, 9, 10, 11, or 12 carbon atoms. Some examples of such phosphonium groups include tetra(n-propyl)phosphonium, tetra(n-butyl)phosphonium, tetra(n-pentyl)phosphonium, tetra(n-hexyl)phosphonium, tetra(n-heptyl)phosphonium, tetra(n-octyl)phosphonium, tetra(n-nonyl)phosphonium, tetra(n-decyl)phosphonium, tetra(n-undecyl)phosphonium, tetra(n-dodecyl)phosphonium, tetra(n-tridecyl)phosphonium, tetra(n-tetradecyl)phosphonium, tetra(n-pentadecyl)phosphonium, tetra(n-hexadecyl)phosphonium, tetra(n-heptadecyl)phosphonium, tetra(n-octadecyl)phosphonium, tetra(n-nonadecyl)phosphonium, and tetra(n-eicosyl)phosphonium, including those containing one or more heteroatoms, e.g., tetra(2-cyanopropyl)phosphonium, tetra(3-cyanobutyl)phosphonium, tetra(2-hydroxypropyl)phosphonium, and tetra(3-hydroxypentyl)phosphonium.

In a second set of embodiments, $R^1$, $R^2$, $R^3$, and $R^4$ are all equivalent saturated branched alkyl groups. The branched alkyl group can be any of those described above under R, particularly those having at least 3, 4, 5, 6, 7, 8, 9, 10, 11, or 12 carbon atoms. Some examples of such phosphonium groups include tetraisopropylphosphonium, tetra(isobutyl)phosphonium (i.e., tetra(2-methylpropyl)phosphonium), tetra(2-ethylhexyl)phosphonium, tetra(3-ethylhexyl)phosphonium, tetra(sec-butyl)phosphonium, tetra(t-butyl)phosphonium, tetra(isopentyl)phosphonium, tetra(isohexyl)phosphonium, tetra(isoheptyl)phosphonium, tetra(isooctyl)phosphonium, tetra(2-ethyloctyl)phosphonium, tetra(isononyl)phosphonium, tetra(isodecyl)phosphonium, and tetra(isododecyl)phosphonium.

In a third set of embodiments, $R^1$, $R^2$, $R^3$, and $R^4$ are all equivalent cycloalkyl groups. The cycloalkyl group can be any of those described above under R. The cycloalkyl group can also be a polycyclic (e.g., bicyclic) group by either possessing a bond between two ring groups (e.g., dicyclohexyl), or by having a shared (e.g., fused) side between two or more ring groups. The cycloalkyl group may or may not be linked to the phosphorus atom by an alkylene (e.g., methylene or ethylene) linker. Some examples of such phosphonium groups include tetracyclopropylphosphonium, tetracyclobutylphosphonium, tetracyclopentylphosphonium, and tetracyclohexylphosphonium.

In a fourth set of embodiments, $R^1$, $R^2$, $R^3$, and $R^4$ are all equivalent straight-chained alkenyl (i.e., olefinic) groups. The straight-chained alkenyl groups can be any of those described above under R, particularly those having at least 3, 4, 5, 6, 7, 8, 9, 10, 11, or 12 carbon atoms. Some examples of such phosphonium groups include tetraallylphosphonium (i.e., tetra(2-propenyl)phosphonium), tetra(1-propenyl)phosphonium, tetra(1-butenyl)phosphonium, tetra(2-butenyl)phosphonium, tetra(3-butenyl)phosphonium, tetra(1-pentenyl)phosphonium, tetra(2-pentenyl)phosphonium, tetra(3-pentenyl)phosphonium, tetra(4-pentenyl)phosphonium, tetra(1-hexenyl)phosphonium, tetra(2-hexenyl)phosphonium, tetra(3-hexenyl)phosphonium, tetra(4-hexenyl)phosphonium, tetra(5-hexenyl)phosphonium, tetra(1-heptenyl)phosphonium, tetra(2-heptenyl)phosphonium, tetra(3-heptenyl)phosphonium, tetra(4-heptenyl)phosphonium, tetra(5-heptenyl)phosphonium, tetra(6-heptenyl)phosphonium, tetra(1-octenyl)phosphonium, tetra(2-octenyl)phosphonium, tetra(3-octenyl)phosphonium, tetra(4-octenyl)phosphonium, tetra(5-octenyl)phosphonium, tetra(6-octenyl)phosphonium, and tetra(7-octenyl)phosphonium, wherein, in any of the foregoing examples, the "yl" ending is equivalent to the designation "1-yl".

In a fifth set of embodiments, $R^1$, $R^2$, $R^3$, and $R^4$ are all equivalent branched alkenyl groups. The branched alkenyl groups can be any of those described above under R, particularly those having at least 3, 4, 5, 6, 7, 8, 9, 10, 11, or 12 carbon atoms. Some examples of such phosphonium groups include tetra(1-propen-2-yl)phosphonium, tetra(1-buten-2-yl)phosphonium, tetra(1-buten-3-yl)phosphonium, tetra(2-buten-2-yl)phosphonium, tetra(1-penten-2-yl)phosphonium, tetra(1-penten-3-yl)phosphonium, tetra(1-penten-4-yl)phosphonium, tetra(2-penten-2-yl)phosphonium, tetra(2-penten-3-yl)phosphonium, tetra(2-penten-4-yl)phosphonium, tetra(1-hexen-2-yl)phosphonium, tetra(1-hexen-3-yl)phosphonium, tetra(1-hexen-4-yl)phosphonium, tetra(1-hexen-5-yl)phosphonium, tetra(2-hexen-2-yl)phosphonium, tetra(2-hexen-3-yl)phosphonium, tetra(2-hexen-4-yl)phosphonium, tetra(2-hexen-5-yl)phosphonium, tetra(3-hexen-2-yl)phosphonium, and tetra(1,4-hexadien-2-yl)phosphonium.

In a sixth set of embodiments, $R^1$, $R^2$, $R^3$, and $R^4$ are all equivalent unsaturated cyclic hydrocarbon groups, such as any of the unsaturated cyclic, bicyclic, or higher polycyclic hydrocarbon groups provided above under (R). Some examples of such phosphonium groups include tetraphenylphosphonium, tetrabenzylphosphonium, or tetrakis(1-naphthyl)phosphonium.

The counteranion ($X^-$) of the ionic liquid is a phosphorus-containing anion having the following generic formula:

(2)

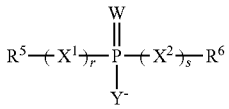

In Formula (2), $R^5$ and $R^6$ are independently selected from any of the hydrocarbon groups (R), described above, having at least three carbon atoms, wherein the hydrocarbon groups are optionally substituted with one or more fluorine atoms. The groups $X^1$, $X^2$, W, and Y are independently selected from O and S atoms, and the subscripts r and s are independently selected from 0 and 1. In particular embodiments, one or both of $R^5$ and $R^6$ are selected from straight-chained or branched alkyl and/or alkenyl groups having at least 3, 4, 5, or 6, and up to 7, 8, 9, 10, 11, 12, 13, 14, 15, 16, 17, 18, 19, or 20 carbon atoms, or at least 3, 4, 5, 6, 7, or 8, and up to 9, 10, 11, 12, 13, 14, 15, 16, 17, 18, 19, or 20 carbon atoms. In other embodiments, one or both of $R^5$ and $R^6$ are selected from saturated or unsaturated cyclic hydrocarbon groups. In some embodiments, the anion according to Formula (2) is symmetric, while in other embodiments, the anion according to Formula (2) is asymmetric. Moreover, $R^5$ and $R^6$ can optionally be interconnected to form a cyclic structure.

In one set of embodiments of Formula (2), all of $X^1$, $X^2$, W, and Y are oxygen atoms, which corresponds to the following sub-formula:

(2-1)

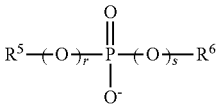

In a separate set of embodiments of Formula (2), subscripts r and s are both 1, which corresponds to the following sub-formula:

(2a)

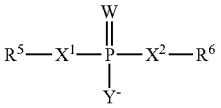

In one set of embodiments of Formula (2a), all of $X^1$, $X^2$, W, and Y are oxygen atoms, which corresponds to the following sub-formula (i.e., phosphate diester):

(2a-1)

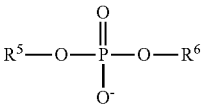

In another set of embodiments of Formula (2a), one of $X^1$, $X^2$, W, and Y is a sulfur atom. Generally, the single sulfur atom is at group W, which corresponds to the following sub-formula (i.e., thiophosphate diester):

(2a-2)

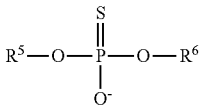

In another set of embodiments of Formula (2a), two of $X^1$, $X^2$, W, and Y are sulfur atoms. Generally, the two sulfur atoms are at groups W and Y, which corresponds to the following sub-formula (i.e., dithiophosphate diester):

(2a-3)

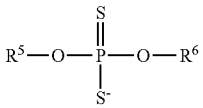

In the above formula, one or two of the remaining oxygen atoms may be replaced with sulfur atoms to result in a trithiophosphate or tetrathiophosphate species, respectively.

In a separate set of embodiments of Formula (2), one of subscripts r and s is 0 (e.g., r is 1 and s is 0), which corresponds to the following sub-formula:

(2b)

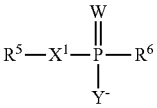

In one set of embodiments of Formula (2b), all of $X^1$, W, and Y are oxygen atoms, which corresponds to the following sub-formula (i.e., phosphonate ester):

(2b-1)

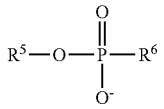

In another set of embodiments of Formula (2b), one of $X^1$, W, and Y is a sulfur atom. Generally, the single sulfur atom is at group W, which corresponds to the following sub-formula (i.e., thiophosphonate ester):

(2b-2)

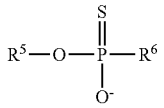

In another set of embodiments of Formula (2b), two of $X^1$, W, and Y are sulfur atoms. Generally, the two sulfur atoms are at groups W and Y, which corresponds to the following sub-formula (i.e., dithiophosphonate ester):

(2b-3)

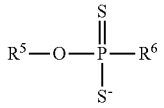

In the above formula, the remaining oxygen atom may be replaced with a sulfur atom to result in a trithiophosphonate species.

In a separate set of embodiments of Formula (2), both subscripts r and s are 0, which corresponds to the following sub-formula:

(2c)

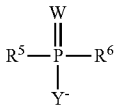

In one set of embodiments of Formula (2c), both of W and Y are oxygen atoms, which corresponds to the following sub-formula (i.e., phosphinate):

(2c-1)

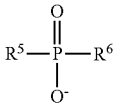

In another set of embodiments of Formula (2c), one of W and Y is a sulfur atom. Generally, the single sulfur atom is at group W, which corresponds to the following sub-formula (i.e., thiophosphinate):

(2c-2)

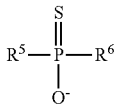

In another set of embodiments of Formula (2c), both W and Y are sulfur atoms, which corresponds to the following sub-formula (i.e., dithiophosphinate):

(2c-3)

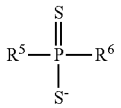

In yet other embodiments of Formula (2) or any of its sub-formulas, r and s are both 1 (i.e., $X^1$ and $X^2$ are both present), but one of $R^5$ or $R^6$ may be absent, which results in a divalent anion. The divalent anion can be depicted, for example, as follows:

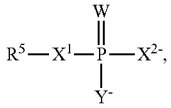

or in exemplary sub-embodiments thereof:

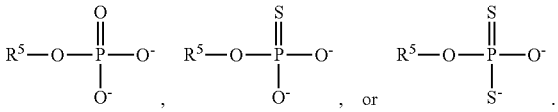

The ionic liquid compound includes any of the above cationic phosphonium species (herein identified as $L^+$) and any of the above anionic species $X^-$, in accordance with Formula (1). The ionic liquid compound can be conveniently expressed by the formula $L^+X^-$, wherein $L^+$ is a cationic component of the ionic liquid and $X^-$ is an anionic component of the ionic liquid. The formula $(L^+)(X^-)$ is meant to encompass a cationic component ($L^+$) having any valency of positive charge, and an anionic component ($X^-$) having any valency of negative charge, provided that the charge contributions from the cationic portion and anionic portion are counterbalanced in order for charge neutrality to be preserved in the ionic liquid molecule. More specifically, the formula $(L^+)(X^-)$ is meant to encompass the more generic formula $(L^{+a})_y(X^{-b})_x$, wherein the variables a and b are, independently, non-zero integers, and the subscript variables x and y are, independently, non-zero integers, such that a.y=b.x (wherein the period placed between variables indicates multiplication of the variables). The foregoing generic formula encompasses numerous possible sub-formulas, such as, for example, $(L^+)(X^-)$, $(L^{+2})(X^-)_2$, $(L^+)_2(X^{-2})$, $(L^{+2})_2(X^{-2})_2$, $(L^{+3})(X^-)_3$, $(L^{+3})_3(X^{-3})$, $(L^{+3})_2(L^{-2})_3$, and $(L^{+2})_3(X^{-3})_2$.

The ionic liquids described above can be synthesized by methodologies well known in the art. The methodologies typically involve salt-forming exchange between cationic- and anionic-containing precursor compounds. For example, a phosphonium halide compound of the formula $[PR^1R^2R^3R^4]^+[X']^-$ (where the halide X' is typically chloride, bromide, or iodide) can be reacted with the acid or salt form of any of the phosphorus-containing anions described above to form an ionic liquid according to Formula (1) above, with concomitant liberation of the corresponding hydrogen halide or halide salt. Such methods are described, for example, in J. Qu, et al., *Applied Materials and Interfaces,* 4, pp. 997-1002, 2012, which is herein incorporated by reference in its entirety.

In another aspect, the invention is directed to a lubricant composition that includes one or more of the ionic liquids described above dissolved in a base oil. The term "dissolved", as used herein, indicates complete dissolution of the ionic liquid in the base oil, i.e., the ionic liquid is completely miscible in the base oil. In different embodiments, the ionic liquid is dissolved in the base oil in an amount of at least 0.1, 0.5, 1, 2, 3, 4, 5, 10, 15, 20, 25, 30, 35, 40, 45, 50, 55, 60, 65, 70, 75, 80, 85, or 90 wt % (i.e., weight of ionic liquid by weight of the total of ionic liquid and base oil) or dissolved in the base oil within a range bounded by any two of the foregoing values. Generally, the ionic liquid in the lubricant composition is one, two, or more selected from any of the ionic liquids herein described, in the absence of other ionic liquids that do not possess the features of the instantly described ionic liquids, such as a symmetric phosphonium cation component or a phosphorus-containing anion. In some embodiments, the lubricant composition having any of the above concentrations of ionic liquids is used directly as a lubricant without diluting in additional oil or organic solvent. In other embodiments, the lubricant composition having any of the above concentrations of ionic liquid is diluted before use. Thus, any of the above-described lubricant compositions having any of the above concentrations of ionic liquid (particularly those of higher concentration, e.g., at least 10, 20, 30, 40, or 50 wt %) may be stored as a commodity, and optionally diluted, prior to use.

The base oil can be any of the polar or non-polar base oils known in the art useful as mechanical lubricating oils. As well known in the art, the mechanical lubricating oil can be further classified as, for example, an engine (motor) lubricating oil, industrial lubricating oil, or metal working fluid. The classification, uses, and properties of such oils are well known in the art, as provided, for example, by U.S. Pat. No. 8,268,760, the contents of which are herein incorporated by reference in their entirety. In particular, the base oil may belong to any of the well established five categories of hydrocarbon oils (i.e., Groups I, II, III, IV, or V) classified according to the extent of saturates, sulfur, and viscosity index. The base oil can have any of the typical boiling points, e.g., at least 100, 120, 150, 180, or 200° C. and up to 250, 300, 350, 400, 450, or 500° C. In some embodiments, the base oil is a synthetic oil, such as any of the Groups I-V, and may or may not include polyalphaolefins (PAO). Some other synthetic oils include hydrogenated polyolefins, esters, fluorocarbons, and silicones. In other embodiments, the base oil may be natural, such as a mineral oil, vegetable oil, or animal oil. In yet other embodiments, the base oil may have a substantially high enough viscosity to qualify it as a grease, wherein the grease typically lowers in viscosity during use by virtue of heat generated during use.

The lubricant composition may also include any one or more lubricant additives well known in the art. The term "additive", as used herein, is understood to be a compound or material, or mixture of compounds or materials, that provides an adjunct or auxiliary effect at low concentrations, typically up to or less than 1, 2, 5, 7, or 10 wt % by weight of the lubricant composition. The additive can be, for example, an anti-wear additive (typically metal-containing), extreme pressure additive, metal chelator, ultraviolet stabilizer, radical scavenger, anti-oxidant, corrosion inhibitor, friction modifier, detergent, surfactant, anti-foaming agent, viscosity modifier (viscosity index improver), or anti-foaming agent, or combination thereof, all of which are well known in the art, as further described in U.S. Pat. Nos. 8,455,407 and 8,268,760, both of which are herein incorporated by reference in their entirety.

In particular embodiments, the lubricating composition described above includes a non-ionic liquid (non-IL) anti-wear additive, such as a metal-containing dithiophosphate, sulfur-containing fatty acid or ester thereof, dialkyl sulfide, dithiocarbamate, polysulfide, or boric acid ester. In further embodiments, the additive is a metal-containing dialkyldithiophosphate or dialkyldithiocarbamate, wherein the metal is typically zinc or molybdenum, as in zinc dialkyldithiophosphate (ZDDP) or molybdenum dialkyldithiocarbamate (MoDTC), and the alkyl groups typically include between 3 and 12 carbon atoms and can be linear or branched. The anti-wear additive can be included in the lubricating composition in any suitable amount typically used in the art, such as between 1 and 15 wt %. In some embodiments, the anti-wear additive is advantageously used in an amount less than typically used in the art, e.g., in an amount of less than 1 wt %, or up to or less than 0.5 or 0.1 wt %, by virtue of the improved properties provided by the instantly described ionic liquids or by a synergistic interaction between the instantly described ionic liquids and the non-IL anti-wear additive.

In one embodiment, the ionic liquid or the lubricating composition is not dissolved, admixed with, or otherwise in contact with a non-ionic liquid organic solvent (i.e., "solvent"). In other embodiments, the ionic liquid is dissolved in, or admixed with, or in contact with one or more organic solvents, either in the absence or presence of a base oil. If the ionic liquid is dissolved in a base oil, then the organic solvent should be completely soluble in the base oil. The organic solvent can be, for example, protic or non-protic and either polar or non-polar. Some examples of protic organic solvents include the alcohols, particularly those more hydrophobic than methanol or ethanol, such as n-propanol, isopropanol, n-butanol, sec-butanol, isobutanol, t-butanol, n-pentanol, isopentanol, 3-pentanol, neopentyl alcohol, n-hexanol, 2-hexanol, 3-hexanol, 3-methyl-1-pentanol, 3,3-dimethyl-1-butanol, isohexanol, and cyclohexanol. Some examples of polar aprotic solvents include ether (e.g., diethyl ether, 1,2-dimethoxyethane, 1,2-diethoxyethane, 1,3-dioxolane, and tetrahydrofuran), ester (e.g., 1,4-butyrolactone, ethylacetate, methylpropionate, and ethylpropionate), nitrile (e.g., acetonitrile, propionitrile, and butyronitrile), sulfoxide (e.g., dimethyl sulfoxide, ethyl methyl sulfoxide, diethyl sulfoxide, methyl propyl sulfoxide, and ethyl propyl sulfoxide), and amide solvents (e.g., N,N-dimethylformamide, N,N-diethylformamide, acetamide, and dimethylacetamide). Some examples of non-polar solvents include the liquid hydrocarbons, such as the pentanes, hexanes, heptanes, octanes, pentenes, hexenes, heptenes, octenes, benzene, toluenes, and xylenes.

In another aspect, the invention is directed to methods for using the above-described ionic liquids, either autonomously (i.e., in the absence of a base oil) or within a lubricant composition, for reducing wear and/or reducing friction in a mechanical device for which lubricity is beneficial. The mechanical device may be, for example, a bearing (e.g., a slide bearing, ball bearing, rolling element bearing, or jewel bearing), piston, turbine fan, rotary blade, compressor blade, gear, axle, engine part (e.g., engine valve, piston, cylinder, or transmission), hydraulic system, or metal cutting tool or machine. The parts being lubricated are typically constructed of a metal or metal alloy, which may be or include, for example, steel, iron, aluminum, nickel, titanium, or magnesium, or a composite or alloy thereof. If used autonomously, the ionic liquid is not included in a base oil, but may be combined with any one or more of the additives described above if the ionic liquid and additive are miscible with each other. The ionic liquid or lubricant composition described above can be applied to a mechanical component by any means known in the art. For example, the component may be immersed in the ionic liquid compound, or a coating (film) of the ionic liquid compound may be applied to the component by, e.g., dipping, spraying, painting, or spin-coating.

In some embodiments, a single ionic liquid compound according to Formula (1) is used, while in other embodiments, a combination of two or more ionic liquid compounds according to Formula (1) is used. In a first incarnation, the combination of ionic liquid compounds corresponds to the presence of two or more cationic species of any of those described above in the presence of a single anionic species of any of those described above. In a second incarnation, the combination of ionic liquid compounds corresponds to the presence of a single cationic species in the presence of two or more anionic species. In a third incarnation, the combination of ionic liquid compounds corresponds to the presence of two or more cationic species of any of those described above in the presence of two or more anionic species of any of those described above.

The ionic liquids described above reduce wear and/or friction. In some embodiments, the ionic liquid or lubricating composition in which it is incorporated provides a coefficient of friction (i.e., friction coefficient) of up to or less than, for example, 0.5, 0.4, 0.3, 0.2, 0.1, or 0.05, or a reduction in friction by any of the foregoing values or by at least 10, 20, 30, 40, 50, 60, 70, 80, or 90%. In other embodiments, the ionic liquid or lubricating composition may or may not have an appreciable effect on friction, but may reduce the wear rate, e.g., by at least or greater than 10, 20, 30, 40, or 50%. In yet other embodiments, the ionic liquid or lubricating composition may or may not also improve the corrosion resistance of the treated substrate. The improved corrosion resistance may be evidenced by a resistance to corrosion in air or after treatment in a liquid corrosion test, such as treatment in a salt solution of at least 0.1 M, 0.2 M, 0.5 M, 1.0 M, 1.5 M, or 2.0 M concentration for at least 0.5, 1, 2, 3, 4, 5, 6, 12, 18, 24, 36, or 48 hours. In still other embodiments, the ionic liquids described herein may provide a multiplicity of functions, which can be two or more of, for example, anti-wear, extreme pressure, friction modifier, anti-oxidant, detergent, and anti-corrosion functions.

Examples have been set forth below for the purpose of illustration and to describe certain specific embodiments of the invention. However, the scope of this invention is not to be in any way limited by the examples set forth herein.

EXAMPLES

Overview

The symmetric ionic liquid tetraoctylphosphonium bis(2-ethylhexyl)phosphate ([P8888][DEHP]), which is in accordance with the instant disclosure, was studied and compared with the following two asymmetric ionic liquids not in accordance with the instant disclosure: trihexyltetradecylphosphonium bis(2-ethylhexyl)phosphate ([P66614][DEHP]) and tributyltetradecylphosphonium bis(2-ethylhexyl)phosphate ([P44414][DEHP]). The structures of the foregoing three ionic liquids (ILs) are shown in FIG. 1.

Synthesis of the Ionic Liquid tetraoctylphosphonium bis(2-ethylhexyl)phosphate ([P8888][DEHP])

Tetraoctylphosphonium bis(2-ethylhexyl)phosphate ([P8888][DEHP]) was synthesized by the following general scheme:

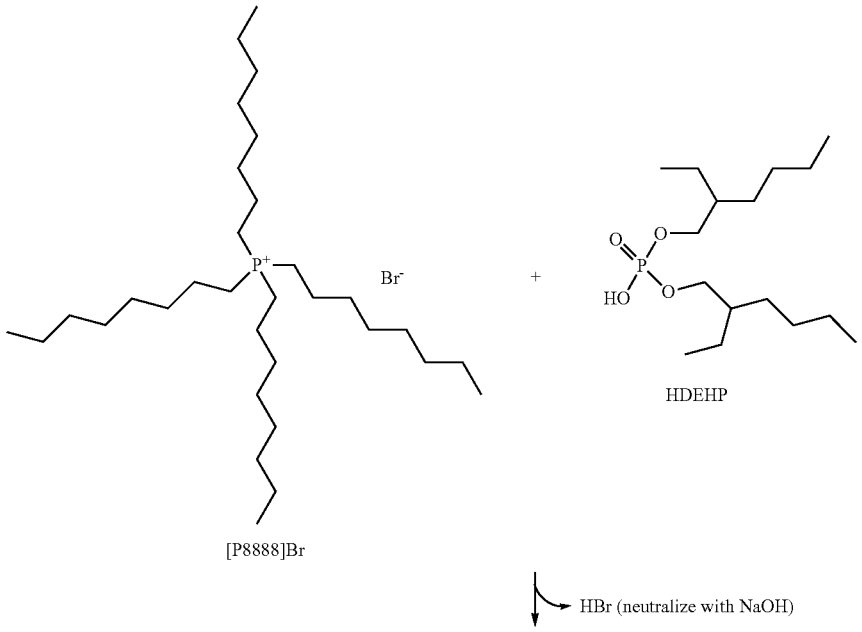

-continued

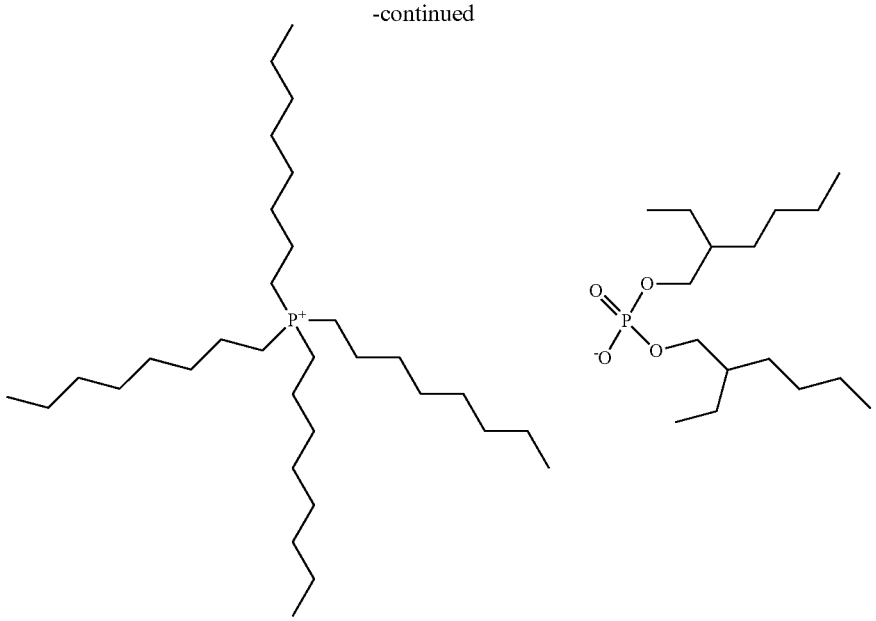

[P8888][DEHP]

Specifically, equal molar amounts of tetraoctylphosphonium bromide ([P8888]Br) and bis(2-ethylhexyl)phosphoric acid (HDEHP) were first mixed in hexane and deionized water. An aqueous solution of sodium hydroxide (NaOH) in equal molar amount to the bromide was then added dropwise into the stirred reaction system, and the mixture stirred at room temperature (ca. 18-27° C.) overnight. The organic phase was separated and washed with deionized water four times to ensure removal of NaBr. The solvent was removed by rotary evaporation and the product dried under vacuum at about 70° C. for four hours.

Density and Viscosity Measurements

The density and viscosity of [P8888][DEHP] were measured and compared with those of [P66614][DEHP] and [P44414][DEHP]. The results are provided in Table 1 below.

TABLE 1

Densities and viscosities of the selected ionic liquids

| | ρ (g/cc) | η (cP) 40° C. | η (cP) 100° C. |
|---|---|---|---|
| [P8888][DEHP] | 0.86 | 608 | 68 |
| [P66614][DEHP] | 0.91 | 390 | 45 |
| [P44414][DEHP] | 0.88 | 252 | 25 |

Corrosion Measurements

Figure 2A:
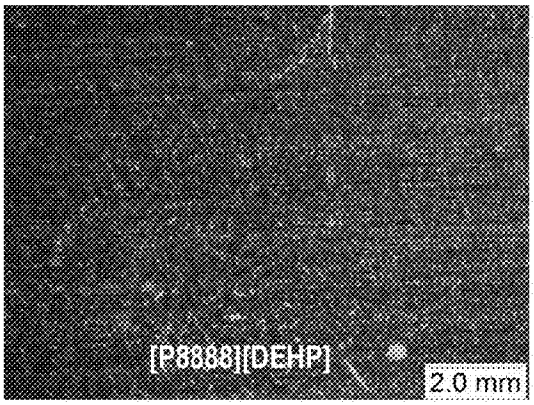
FIGS. 2A-2C. Micrographs of cast iron surfaces after 14 days of exposure to selected ionic liquids [P8888][DEHP], [P66614][DEHP], and [P44414][DEHP], as shown in FIGS. 2A, 2B, and 2C, respectively.
Figure 2B:
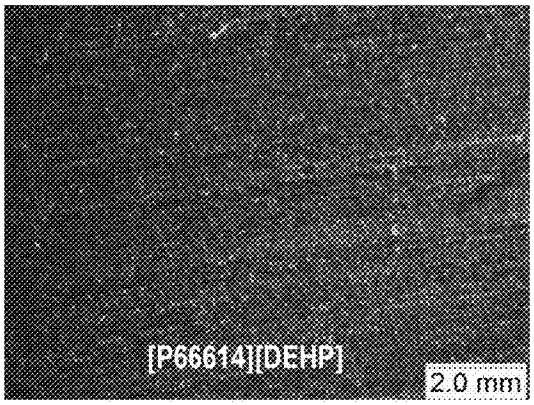
Figure 2C:
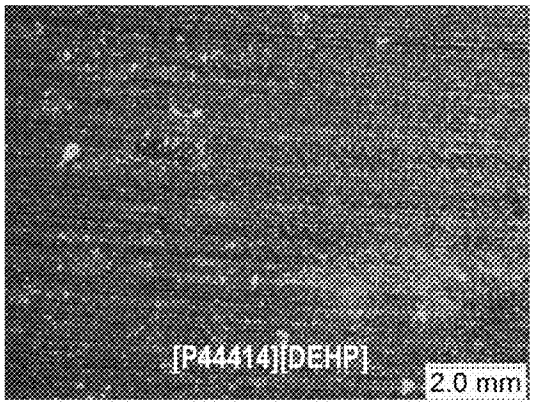

Initial test results suggest that [P8888][DEHP] is not corrosive to gray cast iron. A droplet of each IL was placed on the surface of a piece of grey cast iron. FIGS. 2A-2C are photographs of the surface after fourteen days of exposure, for [P8888][DEHP], [P66614][DEHP], and [P44414][DEHP], respectively. There was no evidence of corrosion on the surfaces exposed to [P8888][DEHP] or [P66614][DEHP], but pitting appeared on the surface exposed to [P44414][DEHP]. Moreover, it was observed that [P44414][DEHP] had a lower hydrophobicity compared to the other two ionic liquids, which may be responsible for the rusting in that case.

Thermal Stability Measurements

Figure 3:
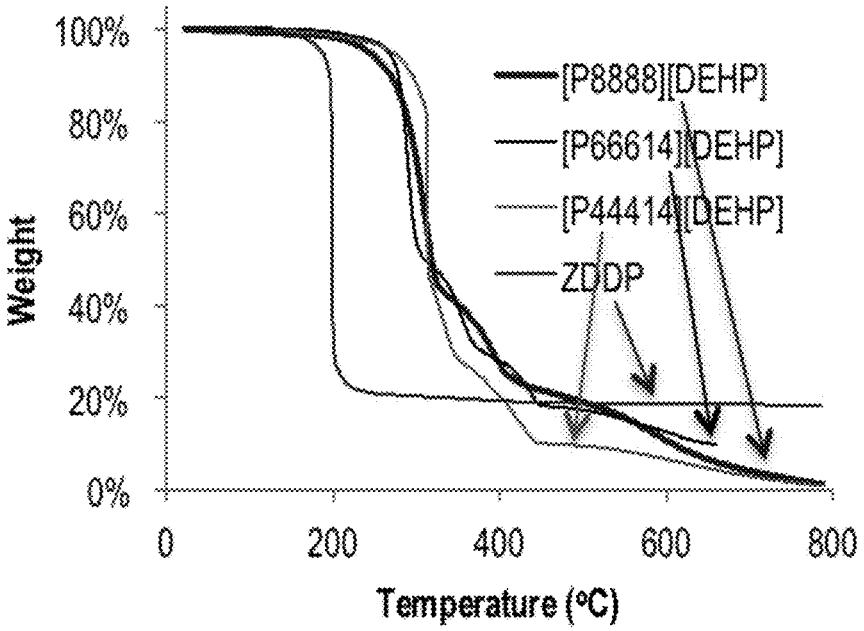
FIG. 3. Thermogravimetric analysis (TGA) graph showing thermal stability behavior for selected ionic liquids [P8888][DEHP], [P66614][DEHP], and [P44414][DEHP], as compared to zinc dialkyldithiophosphate (ZDDP), which is a commercial secondary additive, all in air.

Thermogravimetric analysis (TGA) was performed at a 10° C./min heating rate in air, and the TGA curves of [P8888][DEHP], [P66614][DEHP], [P44414][DEHP], and zinc dialkyldithiophosphate (ZDDP) are provided for comparison in FIG. 3. The two ILs showed similar thermal stability with onset of decomposition at a temperature of 300° C. or higher, which is at least about 100° C. higher than the conventional anti-wear additive ZDDP. ZDDP, when decomposed, left about a 20% solid residue ("ash") because of its zinc content. In contrast, all decomposition products of the ionic liquids were gaseous, thus confirming their "ashless" nature.

Oil Miscibility and Solubility Measurements

As determined by centrifuge technique, the solubilities of [P8888][DEHP], [P66614][DEHP], and [P44414][DEHP] in various hydrocarbon lubricating oils were compared and the results summarized in Table 2 below. As shown, [P8888][DEHP] and [P66614][DEHP] exhibited good miscibility (>10 wt %) in three selected mineral or synthetic base oils, but the oil solubility of [P44414][DEHP] was found to be less than 1%.

TABLE 2

Oil-solubility of selected ionic liquids

| | ExxonMobil PAO 4 cSt base oil | Chevron SAE 10W base oil | Shell GTL 4 cSt base oil |
|---|---|---|---|
| [P8888][DEHP] | >50 wt % | >50 wt % | >50 wt % |
| [P66614][DEHP] | >50 wt % | >50 wt % | >50 wt % |
| [P44414][DEHP] | <1 wt % | <1 wt % | <1 wt % |

Anti-Wear and Friction Reduction Measurements

[P8888][DEHP] ionic liquid was added to Shell gas-to-liquid (GTL) 4 cSt base oil and the resulting blend was evaluated for its anti-wear and friction reduction functionalities. The same treat rate of 1.03 wt % was used for [P8888][DEHP] and [P66614][DEHP]. Results were also compared with the base oil containing 1.0 wt % commercial secondary ZDDP. High contact stress ball-on-flat reciprocating sliding tests (similar to ASTM G 133) were conducted for the oil-IL and oil-ZDDP blends. The test materials were AISI 52100 steel balls against CL35 gray cast iron flats. All tests were performed at 100° C. (a typical engine lubricant temperature) under a constant 100 N load and 10 Hz oscillation with a 10 mm stroke for a total 1000 m sliding distance. At least three repeat tests were given for each lubricant. The friction and wear results are summarized in Table 3 below.

TABLE 3

Summary of friction and wear results

| | Average friction coefficient | Wear rate ($10^{-6} \times mm^3$/N-m) |
|---|---|---|
| GTL 4 cSt base oil | 0.12 | 11.3 |
| GTL + 1.0% ZDDP | 0.10 | 1.83 |
| GTL + 1.03% [P66614][DEHP] | 0.10 | 1.79 |
| GTL + 1.03% [P8888][DEHP] | 0.10 | 1.05 |

Both ILs reduced friction and wear when added in the base oil. [P66614][DEHP] performed similarly to the commercial anti-wear additive ZDDP. In contrast, as provided in the results in Table 3, the symmetric [P8888][DEHP] generated a lower wear rate by greater than 40% as compared to the asymmetric [P66614][DEHP] or ZDDP.

Elucidation of Anti-Wear Mechanism

Figure 4A:
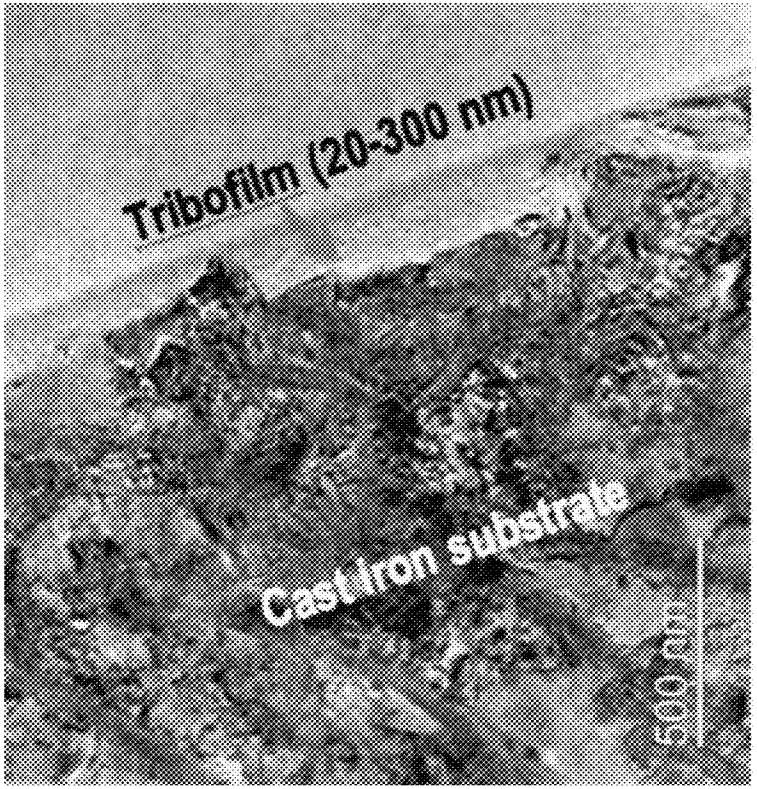
FIGS. 4A-4C. Transmission electron microscope (TEM) images (FIGS. 4A and 4B, lower and higher magnification images, respectively) of the cross-section of a tribo-film on a worn cast iron surface produced by tribological wearing of the cast iron surface while lubricated with a gas-to-liquid (GTL) base oil containing 1.03 wt % [P8888][DEHP] ionic liquid; and corresponding electron diffraction pattern (FIG. 4C, top-right) of the tribofilm cross-section shown in FIG. 4C, top-left, and energy dispersive spectroscopy (EDS) elemental maps of the tribofilm cross-section (FIG. 4C, bottom three panels, corresponding to key elements Fe, O, and P). The results evidence a tribo-film resulting from the presence of the [P8888][DEHP] ionic liquid.
Figure 4B:
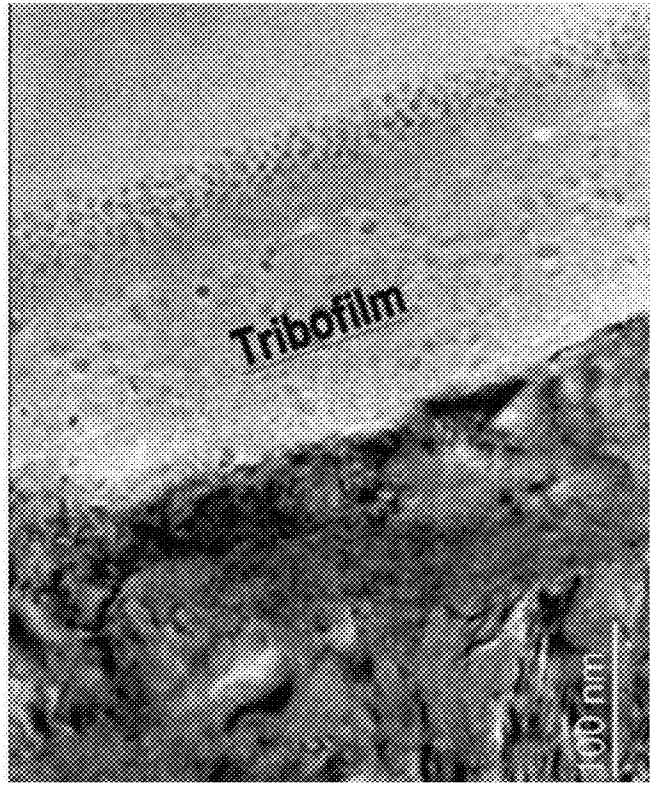
Figure 4C:
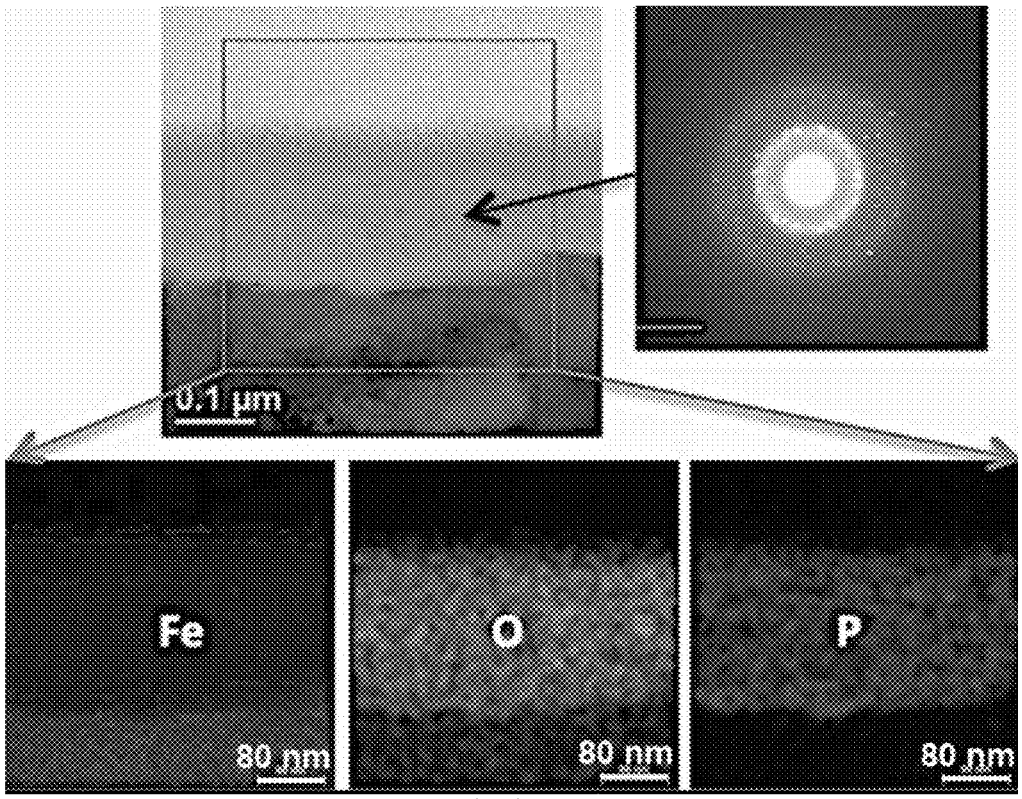
Figure 5A:
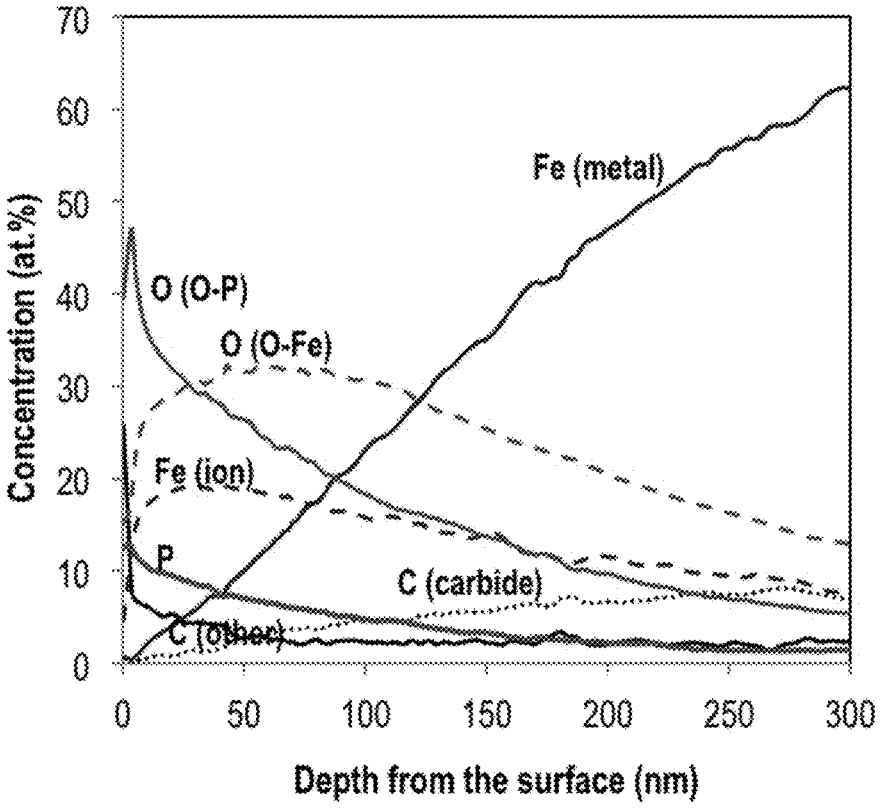
FIGS. 5A, 5B. X-ray photoelectron spectroscopic (XPS) depth-composition profile (FIG. 5A) and binding energy spectra (FIG. 5B) of key elements (Fe, O, and P) of the worn area whose cross-section is shown in FIG. 4A.
Figure 5B:
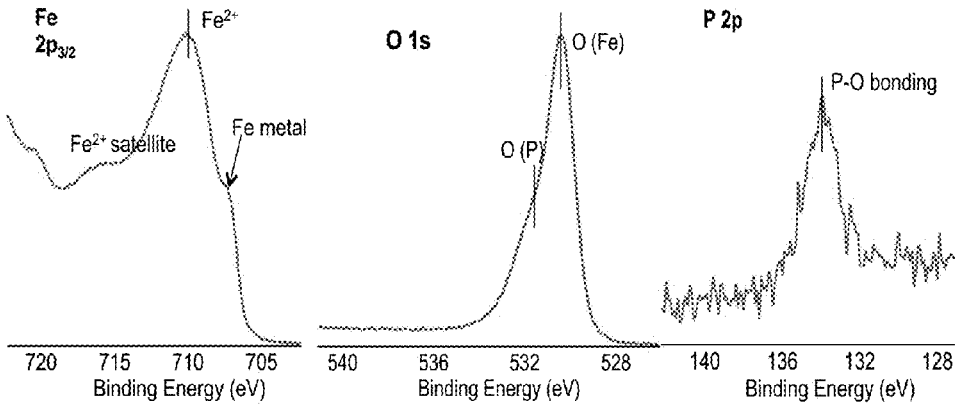

An earlier report (J. Qu, et al., *ACS Applied Materials & Interfaces,* 4 (2), 2012, pp. 997-1002) revealed a protective tribo-film on the contact area lubricated by oils containing the ionic liquid [P66614][DEHP]. Using similar microstructure characterization and chemical analysis characterization techniques described in the above-cited reference, a similar tribo-film was herein observed to be present on the worn surface lubricated by the GTL oil containing 1.03 wt % [P8888][DEHP]. The foregoing results are supported by the TEM images (FIGS. 4A and 4B), as well as electron diffraction pattern (top-right of FIG. 4C) and EDS elemental mapping (bottom three panels of FIG. 4C) of the cross section of the tribo-film shown in FIGS. 4A and 4B (as also shown in FIG. 4C top-left). The TEM images (FIGS. 4A and 4B) show the nanostructure and film thickness. The electron diffraction pattern (top-right of FIG. 4C) suggests an amorphous matrix embedded with nanocrystals. The EDS elemental maps (FIG. 4C, bottom three panels) reveal the tribofilm chemical composition. Moreover, the XPS depth-composition profile (FIG. 5A) and binding energy spectra of key elements (FIG. 5B) indicate that the tribofilm is composed of iron phosphates, iron oxides, and some carbonaceous compounds. The results suggest a similar wear protection mechanism between the two ionic liquids, [P8888][DEHP] and [P66614][DEHP]. Thus, the observed improvement in the wear protection of the instantly described symmetric ionic liquid over the asymmetric ionic liquid is highly unexpected. The precise mechanism at work in the observed improvement has not been fully elucidated at this time.

Corrosion Inhibition Measurements

Figure 6:
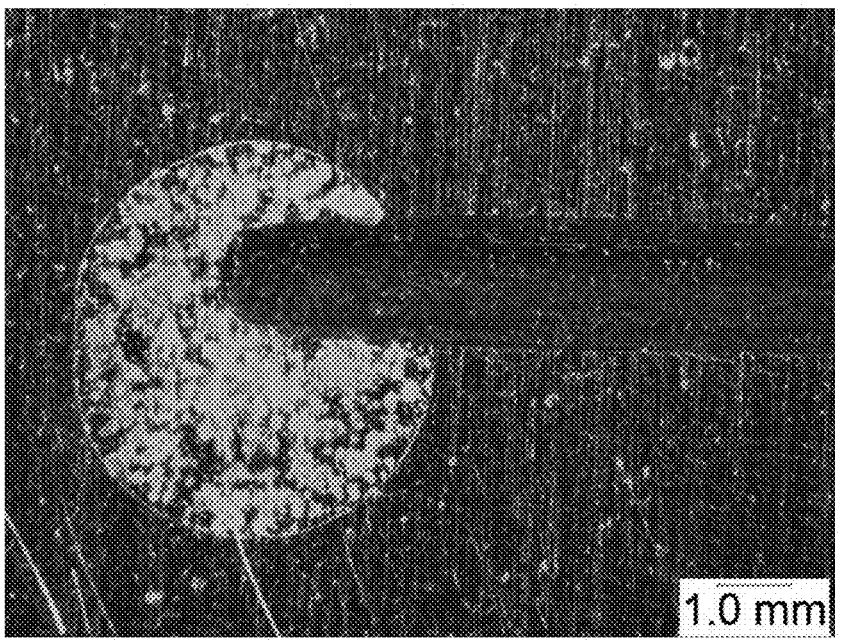
FIG. 6. Micrograph of the wear area whose cross-section is shown in FIG. 4*a* after contact with a water droplet. The micrograph shows improved corrosion resistance in the surface area covered by the tribo-film induced by the [P8888][DEHP] ionic liquid.

The initial analysis, described above, suggests an improved corrosion resistance for the surface area covered by a tribo-film induced by [P8888][DEHP]. To further elucidate the corrosion inhibitory ability, an experiment was conducted in which a water droplet was placed on the cast iron surface containing the tribo-film induced by [P8888][DEHP]. As shown in the photograph provided in FIG. 6, the surface area outside the wear scar (lubricated by GTL+1.03% [P8888][DEHP]) rusted in minutes. In contrast, the area within the wear scar showed no rust even after the water droplet completely dried, which is attributed to the protection by the tribo-film.

Synergy Between [P8888][DEHP] and ZDDP

Figure 7:
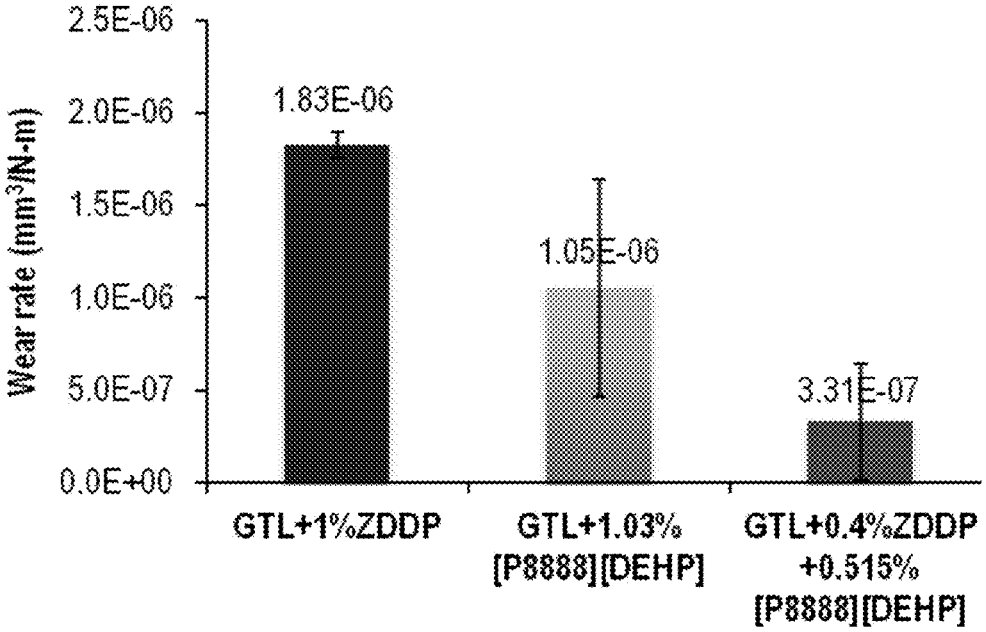
FIG. 7. Bar graph comparing wear rates for 1% ZDDP in GTL base oil, 1.03% [P8888][DEHP] ionic liquid in GTL base oil, and combination of 0.4% ZDDP and 0.515% [P8888][DEHP] in GTL base oil.
Figure 8:
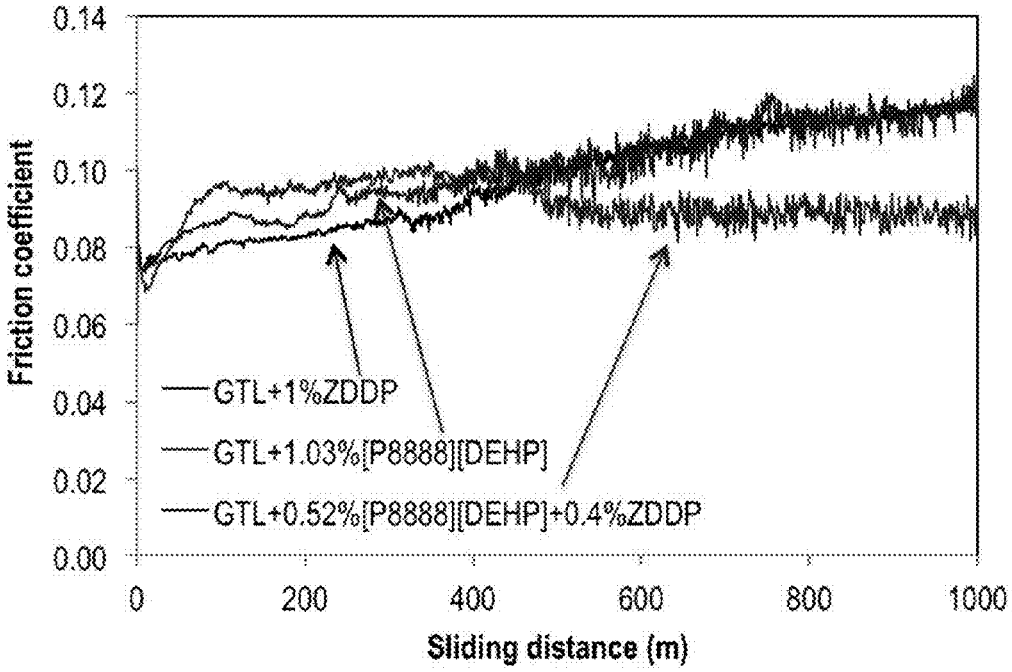
FIG. 8. Graph comparing friction behavior for 1% ZDDP in GTL base oil, 1.03% [P8888][DEHP] ionic liquid in GTL base oil, and combination of 0.4% ZDDP and 0.515% [P8888][DEHP] in GTL base oil.

Wear rates were measured for the following three separate compositions: 1 wt % ZDDP in GTL base oil, 1.03 wt % [P8888][DEHP] ionic liquid in GTL base oil, and combination of 0.4 wt % ZDDP and 0.515 wt % [P8888][DEHP] in GTL base oil. The wear and friction results are summarized in FIGS. 7 and 8, respectively. As shown, the combination of 0.4 wt % ZDDP and 0.515 wt % [P8888][DEHP] yielded the lowest friction. As ZDDP exhibited a wear rate of $1.83\times10^{-6}$ $mm^3$/N-m, and [P8888][DEHP] exhibited a wear rate of $1.05\times10^{-6}$ $mm^3$/N-m, the expected wear rate of a combination of ZDDP and [P8888][DEHP] would be in between the two wear rates. However, as shown by FIG. 7, the combination of ZDDP and [P8888][DEHP] resulted in a surprisingly reduced wear rate of $0.33\times10^{-6}$ $mm^3$/N-m, which is substantially (70-80%) lower than the wear rates for using ZDDP or [P8888][DEHP] alone. Thus, a strong synergistic effect is evidenced.

While there have been shown and described what are at present considered the preferred embodiments of the invention, those skilled in the art may make various changes and modifications which remain within the scope of the invention defined by the appended claims.

What is claimed is:

1. A lubricant composition comprising:

(i) an ionic liquid having the following generic structural formula:

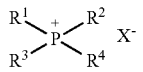

(1)

wherein $R^1$, $R^2$, $R^3$, and $R^4$ are equivalent and selected from alkyl groups containing at least six carbon atoms, and $X^-$ is a phosphorus-containing anion having the following generic structural formula:

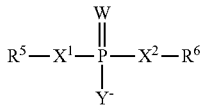

(2a)

wherein $R^5$ and $R^6$ are independently selected from alkyl groups having at least four carbon atoms, wherein the alkyl groups are optionally substituted with one or more fluorine atoms, and $R^5$ and $R^6$ optionally interconnect to form a ring; and $X^1$, $X^2$, W, and Y are independently selected from O and S atoms; and (ii) a base oil;

wherein said ionic liquid is dissolved in an amount of 2 to 10 wt % in said base oil.

2. The lubricant composition of claim 1, wherein said base oil is a mechanical lubricating oil.

3. The lubricant composition of claim 1, wherein said ionic liquid is included in said base oil in an amount of 2 to 5 wt %.

4. The lubricant composition of claim 1, wherein $R^1$, $R^2$, $R^3$, and $R^4$ are equivalent and selected from alkyl groups containing at least eight carbon atoms.

5. The lubricant composition of claim 1, wherein said phosphorus-containing anion has the formula:

(2a-1)

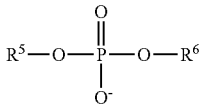

6. The lubricant composition of claim 1, wherein $R^5$ and $R^6$ are alkyl groups containing at least six carbon atoms.

7. The lubricant composition of claim 1, wherein $R^5$ and $R^6$ are branched alkyl groups.

8. The lubricant composition of claim 1, wherein said lubricant composition further comprises a metal-containing anti-wear additive.

9. The lubricant composition of claim 8, wherein said metal-containing anti-wear additive is a zinc dialkyldithiophosphate.

* * * * *